US007836640B1

(12) United States Patent
Pratt

(10) Patent No.: US 7,836,640 B1
(45) Date of Patent: Nov. 23, 2010

(54) WATER DRAINAGE SYSTEM

(76) Inventor: James M. Pratt, P.O. Box 920624, Needham, MA (US) 02492

( * ) Notice: Subject to any disclaimer, the term of this patent is extended or adjusted under 35 U.S.C. 154(b) by 1017 days.

(21) Appl. No.: 11/378,774

(22) Filed: Mar. 20, 2006

(51) Int. Cl.
*E04D 13/14* (2006.01)

(52) U.S. Cl. ..... 52/61; 52/97; 52/169.5; 52/302.6; 52/716.2

(58) Field of Classification Search ..... 52/61, 52/62, 169.5, 58, 60, 302.1, 302.3, 302.6, 52/716.2, 97, 219, 200
See application file for complete search history.

(56) References Cited

U.S. PATENT DOCUMENTS 3,124,427 A * 3/1964 Chomes ..... 428/603
4,745,716 A * 5/1988 Kuypers ..... 52/169.5
5,288,268 A * 2/1994 Kuypers ..... 454/341

* cited by examiner

*Primary Examiner*—Richard E Chilcot, Jr.
*Assistant Examiner*—William V Gilbert
(74) *Attorney, Agent, or Firm*—William Nitkin

(57) ABSTRACT

A water seepage control device having a wall panel positioned vertically against the interior of a foundation wall, a base member extending horizontally from the bottom of the wall panel over a foundation footing, such base member having a plurality of elongated V-shaped formations formed therein extending downward with the points of such V-shaped formations resting on the top of the foundation footing to form a plurality of drain channels therebetween under the base member for directing water, coming down and through the interior foundation wall, through the drain channels and over the end of the foundation footing to a water-collecting area.

9 Claims, 1 Drawing Sheet

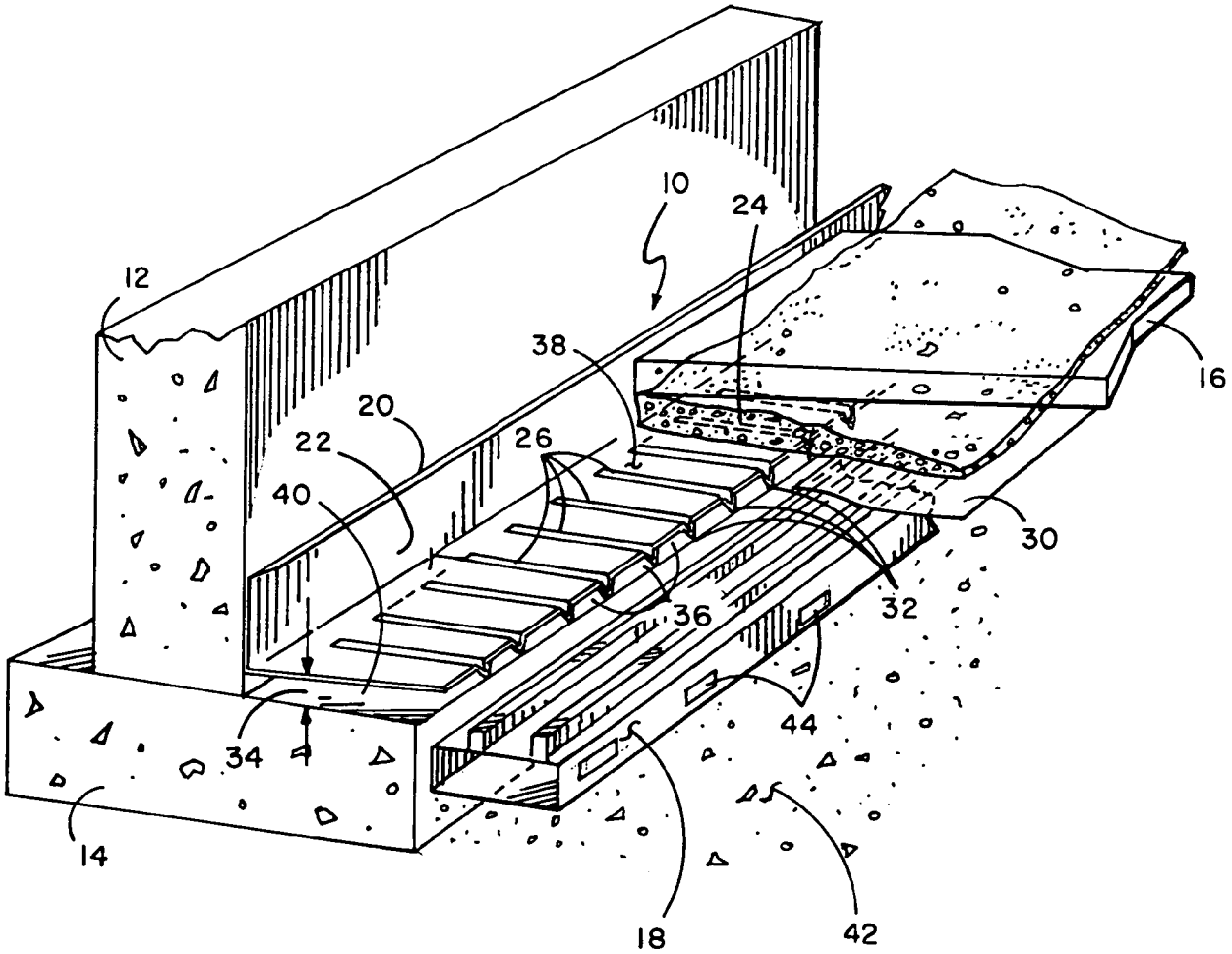
16
30
32
42
44
24
10
36
18
38
26
20
22
40
34
12
14

WATER DRAINAGE SYSTEM

BACKGROUND OF THE INVENTION

1. Field of the Invention

The device of this invention resides in the area of basement water seepage control systems for directing and channeling water into water drainage conduits and more particularly relates to an L-shaped device that is positioned against the inside foundation wall and foundation footing with channels therein for directing water seepage to a drainage conduit disposed at the end of the foundation footing or into the gravel at the end of the foundation footing.

2. History of the Prior Art

There are many water drainage systems that are positioned adjacent to a basement foundation and rest upon the foundation footing. Some of such systems are disclosed in the following U.S. Pat. Nos. 3,283,460 to Patrick; 4,245,443 to Beechen; 4,745,716 to Kuypers; 4,869,032 to Geske; 5,771,643 to Parker; 5,784,838 to Phillips; 6,241,421 to Harvie et al; and 6,672,016 to Janesky.

Typical of the above systems is U.S. Pat. No. 3,283,460 to Patrick which teaches the use of an L-shaped member having a plurality of channels formed in its bottom. The L-shaped member, which fits against the foundation wall and rests upon the foundation footing, has a plurality of elongated channels extending down the portion of the device positioned against the foundation wall which channels then extend down thereunder into the portion resting upon the foundation footing to direct the water under the foundation floor to a gravel bed through which a drainage pipe can extend and receive the water that has passed through such gravel. U.S. Pat. No. 6,672,016 to Janesky teaches an improvement of this subfloor L-shaped drainage device by providing a plastic panel having a plurality of frustoconical protrusions which space the panel away from the foundation wall and the foundation footing so that water can pass therebehind and thereunder to a drainage pipe that is provided within the gravel field under the basement floor or into the gravel itself.

SUMMARY OF THE INVENTION

The device of this invention provides an improved L-shaped water drainage device comprised of a vertical wall panel and a horizontally disposed base member. The vertical wall panel is adapted to be positioned against the inside foundation wall and has a lip at the top of the vertical wall panel extending therefrom at a 45-degree angle away from the foundation wall to catch any water that drips through the foundation wall to cause it to pass behind the vertical wall panel and under the horizontally disposed base member extending at the bottom of the vertical wall panel to water-collecting means located at the end of the foundation footing. A plurality of drain channels are formed beneath the base member by a plurality of elongated V-shaped formations extending downward from the base member, such formations being parallel to one another. Water seeping through the foundation wall or over the footing and under the foundation wall is directed behind the vertical wall panel and passes under the base member through the plurality of drain channels between the base member and the foundation footing to be received by the water-collecting means, such as a drainage conduit, which is disposed in the floor or below the floor at the end of the foundation footing or by the gravel or stone disposed at the end of the foundation footing.

BRIEF DESCRIPTION OF THE DRAWINGS

The FIGURE illustrates a perspective cutaway view of the device of this invention installed against the inside of a foundation wall above the foundation footing.

DESCRIPTION OF THE PREFERRED EMBODIMENT(S)

The FIGURE illustrates a perspective cutaway view of L-shaped device 10 of this invention positioned against foundation wall 12 resting upon foundation footing 14. Seen in this view is vertical wall panel 22 which is disposed against the inside of foundation wall 12. A small lip 20 extends along the top of wall panel 22 inwardly and upwardly at approximately a 45-degree angle which lip helps direct water seeping through the foundation wall so that it will pass behind wall panel 22 and not reach cement floor 16. The water passing down behind vertical wall panel 22 is then directed through a plurality of drain channels 36 formed between the plurality of elongated V-shaped formations 26 which protrude downward from horizontal base member 38 of L-shaped device 10 substantially perpendicular to said wall panel 22. Any other water that might pass over the footing under the foundation wall also will pass through drain channels 36. In a preferred embodiment V-shaped formations 26 can be parallel to one another with the "V"s extending downward approximately ⅜ inch. When the device of this invention is installed, horizontal base member 38 can be covered first by concrete 24 or gravel and then by cement floor 16 up as far as to the level of lip 20. Thus, when installed, horizontal base member 38 is positioned at a height 34 of approximately ⅜ inch above the top of foundation footing 14 such that water can easily pass from behind vertical wall panel 22, under horizontal base member 38, through drain channels 36 located above top 40 of foundation footing 14 to the area under cement floor 16 where the water will pass through ground 42 into a water-collecting means such as drain conduit 18 which has apertures 44 therein to allow water to pass therein for redirection to a water collection means, such as a sump pump and the like. In an alternate embodiment an optional vapor barrier plastic sheet 30 can be placed over drain conduit 18.

In a preferred embodiment the device of this invention can be made of plastic. The elongated V-shaped formations 26 formed as part of horizontal base member 38 of the device of this invention add strength to the device and make for a very sturdy and economical structure which provides ample drain channels. Water is easily directed through these drain channels as there is only the very small area of contact along the points 32 of the "V"s of formations 26 on top 40 of foundation footing 14 to slow the flow of water under the device of this invention to drain conduit 18.

Although the present invention has been described with reference to particular embodiments, it will be apparent to those skilled in the art that variations and modifications can be substituted therefor without departing from the principles and spirit of the invention.

I claim:

1. A device for directing water to a water collector located along a foundation footing, said device adapted to be installed in a basement adjacent to the interior of a foundation wall and above the top of the foundation footing, comprising:

a wall panel having a top edge, a bottom and first and second sides, said wall panel being adapted to overlie a portion of the foundation wall;

a base member extending from the bottom of said wall panel at approximately a right angle and including a substantially planar top surface a substantially planar bottom surface substantially parallel to said top surface, an inner edge at said wall panel and an end edge spaced from said wall panel, said base member being adapted to overlie a portion of the foundation footing;

a portion of said wall panel along said top edge between said first side and second side being bent toward said base member to form a lip;

said base member top surface including a plurality of V-shaped channels formed therein, each of said V-shaped channels projecting from said base member bottom surface and including a channel bottom edge, said V-shaped channels being adapted to support said device on the foundation footing and to define with the foundation footing a plurality of drain channels between adjacent ones of said V-shaped channels for directing water from the foundation wall along the foundation footing toward the water collector; and said V-shaped channels have a first, closed, end spaced from said wall panel and extend away from said wall panel toward said end edge of said base member, and said base member top surface includes a continuous planar strip portion along the wall panel bottom having no channels therein.

2. The device of claim 1 wherein said top surface extends between adjacent pairs of said plurality of V-shaped channels.

3. The device of claim 1 wherein said V-shaped channels have a first, closed, end between said base member inner edge and said base member end edge.

4. The device of claim 1 wherein said V-shaped channels have a second, open, end at said base member end edge.

5. The device of claim 1 wherein said base member top surface includes a plurality of planar tongues extending from said strip portion between adjacent pairs of said V-shaped channels.

6. The device of claim 5, wherein said strip portion and said plurality of planar tongues lie in said plane.

7. The device of claim 1 wherein said V-shaped channels terminate at a distance from said wall panel.

8. A device for directing water to a water collector located along a foundation footing, said device adapted to be installed in a basement adjacent to the interior of a foundation wall and above the top of the foundation footing, comprising:

a wall panel having a top edge, a bottom and first and second sides, said wall panel being adapted to overlie a portion of the foundation wall;

a base member extending from the bottom of said wall panel at approximately a right angle and including a top surface lying in a plane, a bottom surface, an inner edge at said wall panel and an end edge spaced from said wall panel, said base member being adapted to overlie a portion of the foundation footing;

a portion of said wall panel along said top edge between said first side and second side being bent toward said base member to form a lip; and said base member top surface including a plurality of V-shaped channels formed therein, each of said V-shaped channels projecting from said base member bottom surface and including a channel bottom edge, said V-shaped channels being adapted to support said device on the foundation footing and to define with the foundation footing a plurality of drain channels between adjacent ones of said V-shaped channels for directing water from the foundation wall along the foundation footing toward the water collector, each of said V-shaped channels having a first, closed end spaced from said wall panel, and said base member including a planar strip portion between said V-shaped channel closed ends and said wall panel.

9. The device of claim 8 including a plurality of planar tongue portions extending from said planar strip portion between adjacent pairs of said V-shaped channels.

* * * * *